US006708525B2

(12) United States Patent
Rancan

(10) Patent No.: US 6,708,525 B2
(45) Date of Patent: Mar. 23, 2004

(54) OMEGA TYPE ORNAMENTAL CHAIN

(76) Inventor: Pietro Rancan, Via M. L. Marzotto, 30, 36070 Trissino, Vicenza (IT)

( * ) Notice: Subject to any disclaimer, the term of this patent is extended or adjusted under 35 U.S.C. 154(b) by 0 days.

(21) Appl. No.: 09/988,904

(22) Filed: Nov. 19, 2001

(65) Prior Publication Data

US 2002/0038556 A1 Apr. 4, 2002

Related U.S. Application Data

(63) Continuation-in-part of application No. 09/536,672, filed on Mar. 28, 2000, now abandoned.

(51) Int. Cl.[7] ..... A44C 5/00
(52) U.S. Cl. ..... 63/3
(58) Field of Search ..... 63/3

(56) References Cited

U.S. PATENT DOCUMENTS 222,176 A * 12/1879 Boyce ..... 428/589
1,694,703 A * 12/1928 Doppenschmitt ..... 63/11
1,941,684 A * 1/1934 Hiller ..... 63/28
4,362,031 A * 12/1982 Obermuller ..... 63/15
5,611,144 A * 3/1997 Gusky ..... 29/896.411
6,209,306 B1 * 4/2001 Chia et al. ..... 59/80
2002/0029476 A1 3/2002 Lacchetti ..... 29/896.41
2002/0038556 A1 * 4/2002 Rancan ..... 63/3

FOREIGN PATENT DOCUMENTS

FR 2226131 * 11/1974

* cited by examiner

*Primary Examiner*—Andrea Chop
(74) *Attorney, Agent, or Firm*—Stephen E. Feldman PC

(57) ABSTRACT

An ornamental chain of the "Omega" type used for the production of necklaces, bracelets and other articles of jewelry. This chain has two faces having different colors and/or different workmanship corresponding to the two faces. The chain may be worn showing one or the other face. The disclosure also covers the process of production of the chain.

4 Claims, 8 Drawing Sheets

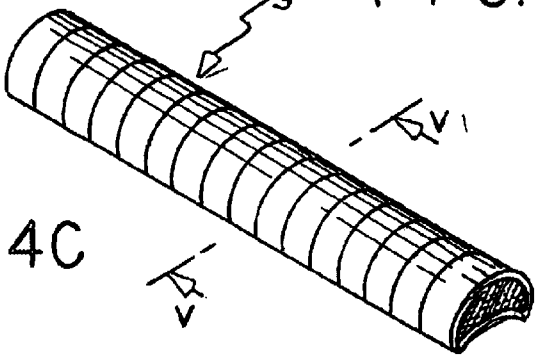
FIG. 4D
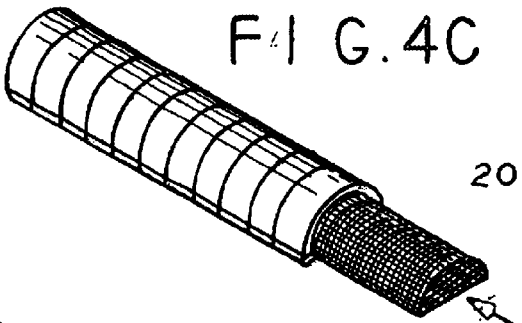
FIG. 4C
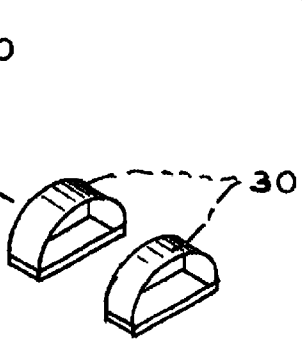
FIG. 4B
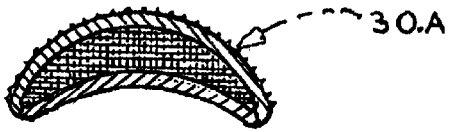
FIG. 5
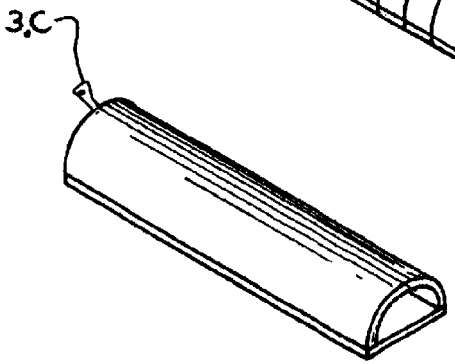
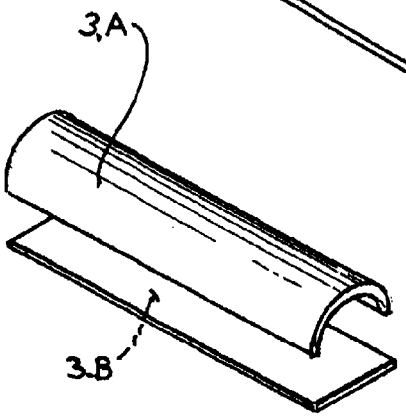
FIG. 4A FIG. 8
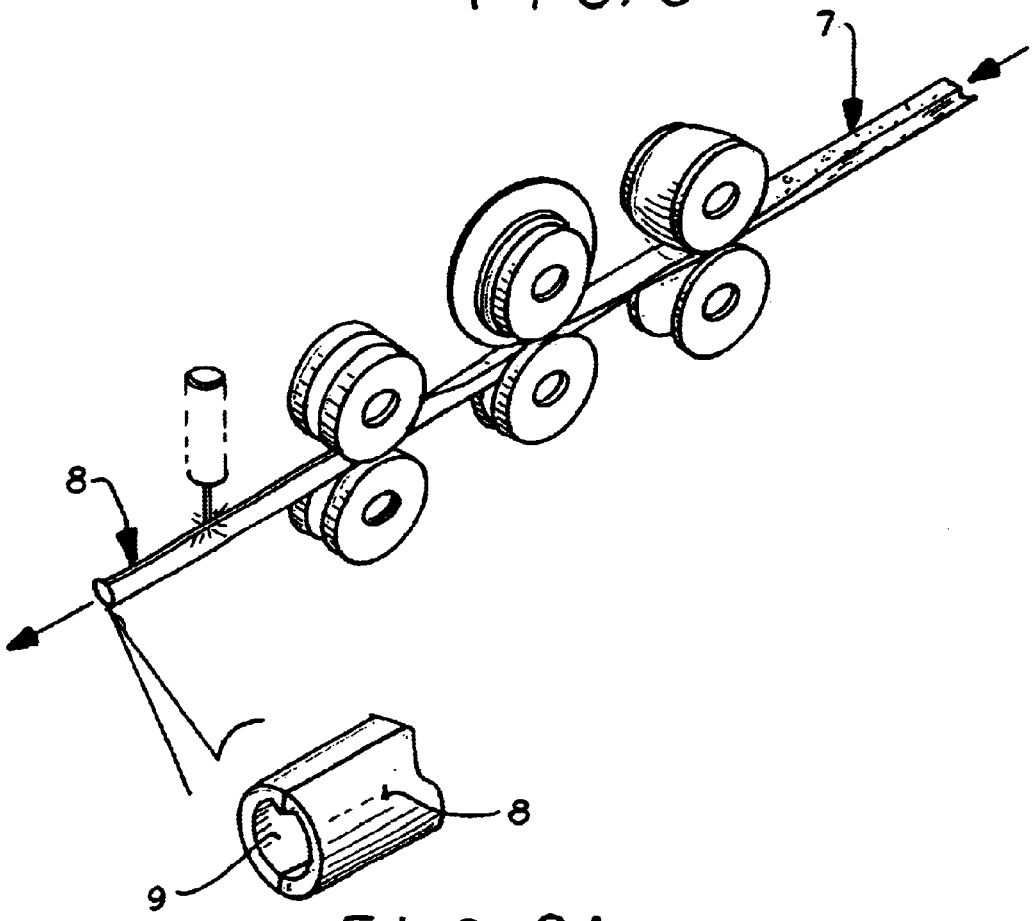
FIG. 8A
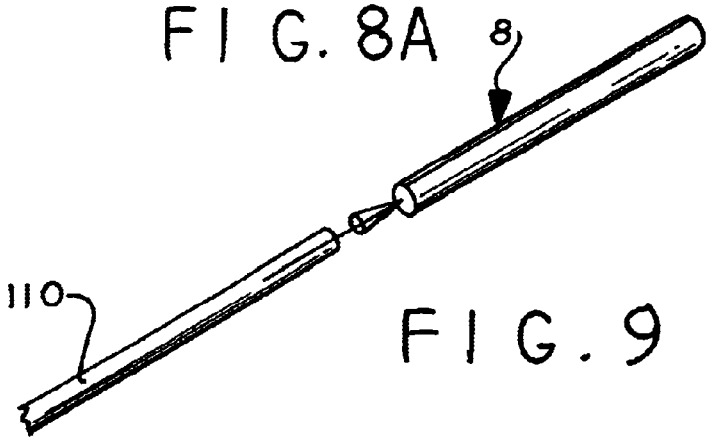
FIG. 9

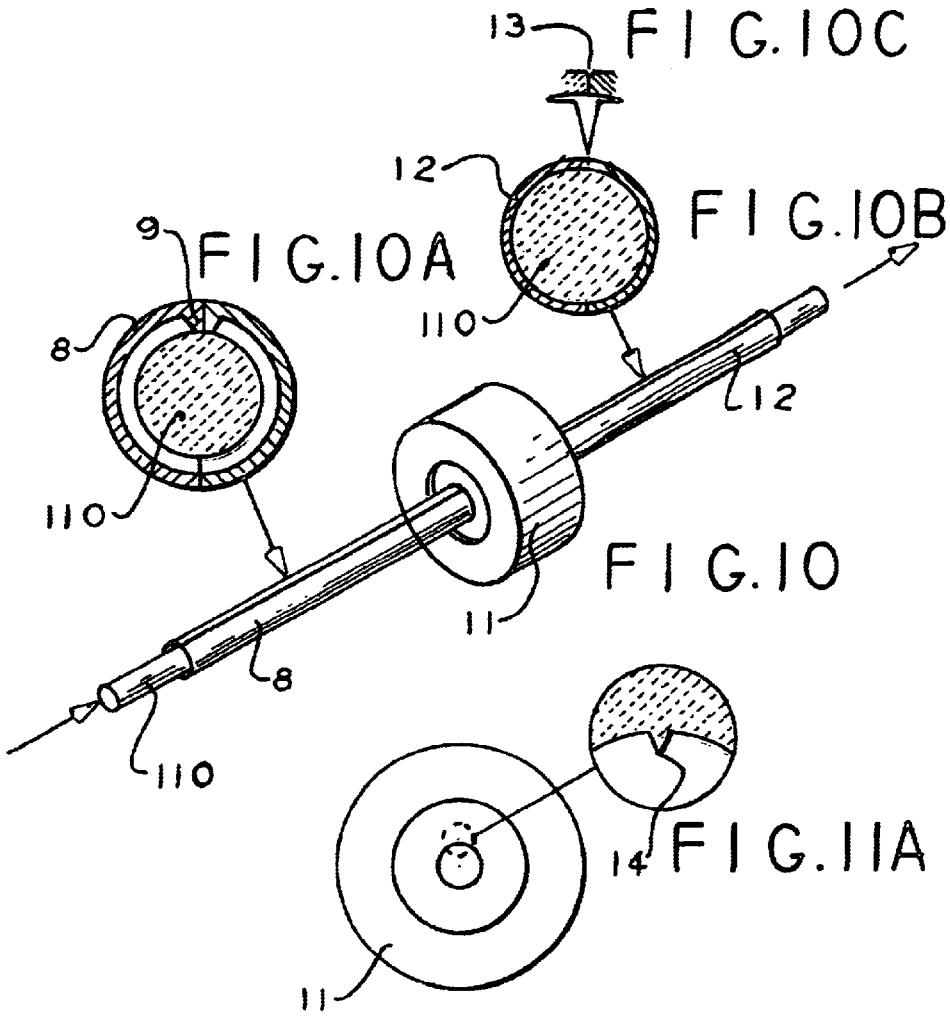
13
FIG.10C
12
FIG.10B
9
FIG.10A
8
110
12
110
FIG.10
11
8
110
14
FIG.11A
11
FIG.11
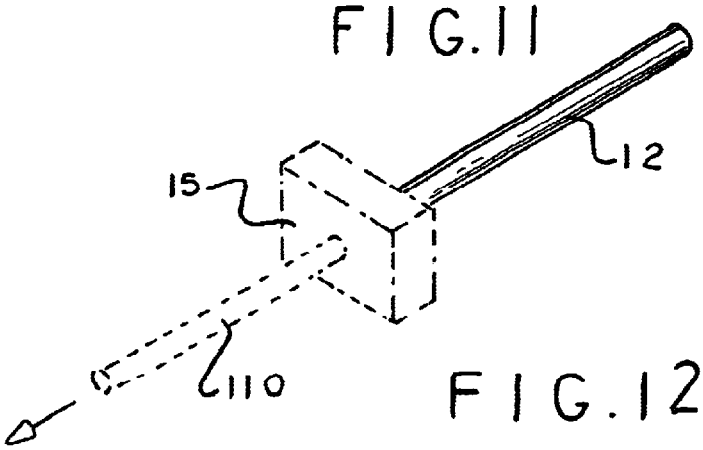
12
15
110
FIG.12

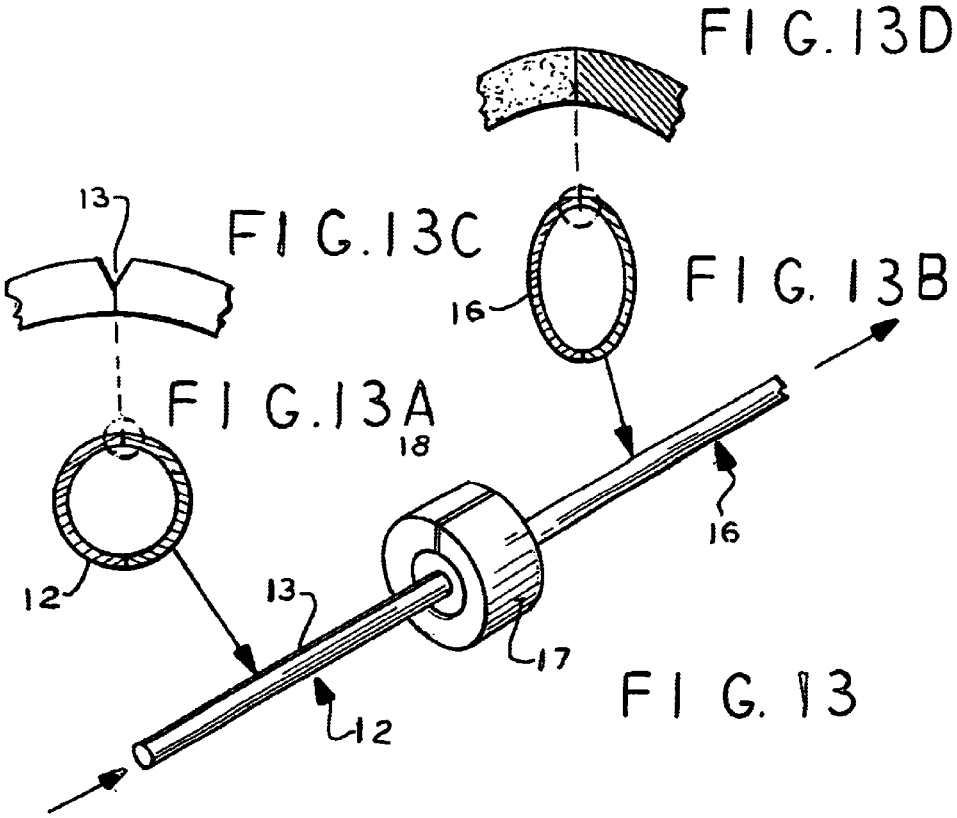
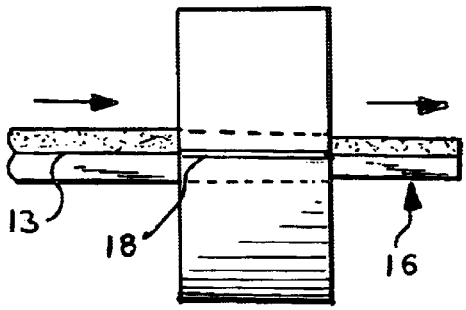
FIG.14

FIG. 15
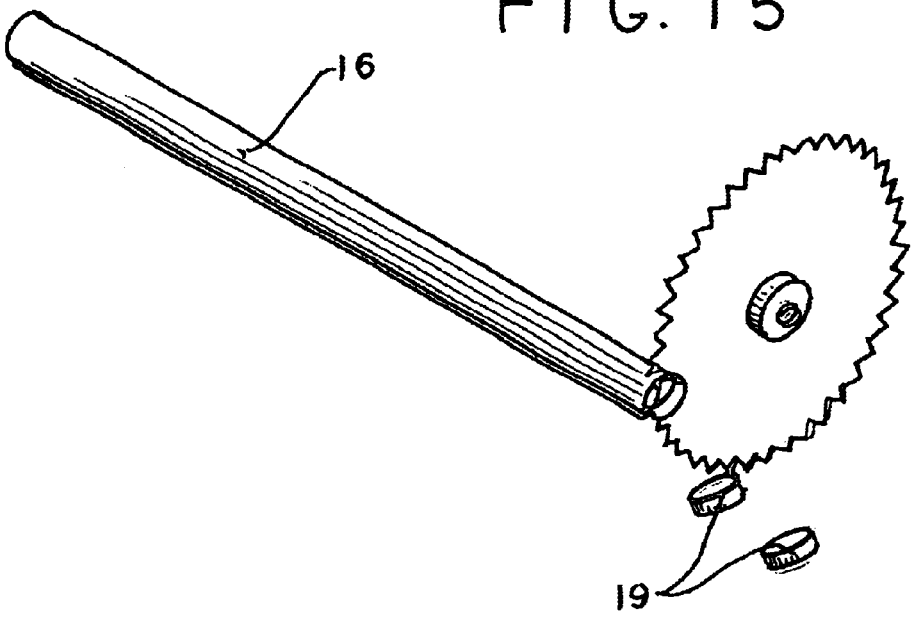
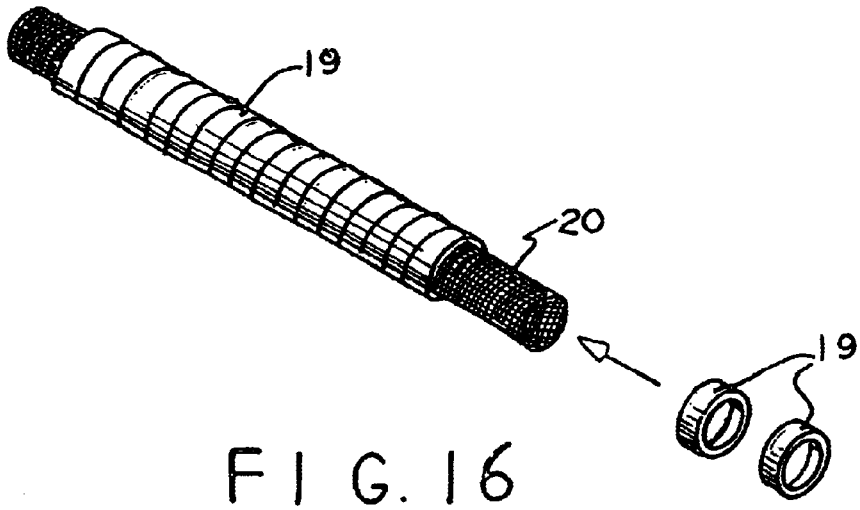
FIG. 16

OMEGA TYPE ORNAMENTAL CHAIN

PENDING APPLICATIONS

This is a Continuation-in-Part of U.S. Ser. No. 09/536,672 filed Mar. 28, 2000 now abandoned.

FIELD OF THE INVENTION

The present invention relates to an "Omega" type ornamental chain and a process for making the chain.

BACKGROUND OF THE INVENTION

It is known that in the goldsmith's field an "Omega" chain is defined as a strip of a fabric having threads over which small rings are inserted. The threads are usually made of gold or other precious material. The small rings which are inserted on the strip of the fabric have a closed profile and a thin thickness, in more detail each ring is composed of a first lamina, usually in the shape of a "C", which is welded to a second lamina which is flat and has the function of forming the closed section of the small ring. The small rings are formed by sawing a cylinder or a tube in order to obtain a plurality-of identical elements.

The process to obtain the "Omega" product always provides a final pressing operation to which the chain is subjected, an operation which always defines a single surface of the product which is aesthetically satisfactory and offers along the entire extension always the same aesthetic properties. Specifically the surface aesthetically satisfactory which eventually may also be worked to achieve particular effects of style, is constituted by the entire surface which is turned towards the exterior while the concave surface is not visible and will be deposited on the skin of the woman who wears the jewel.

On the basis of what has been described it is easy to conclude that the "Omega" chains presently in commerce are characterized by a single and very precise aesthetic appearance so that, for instance, a woman in order to have the possibility of choice or combination with different types of clothing, must buy different types of jewels, for instance necklaces and bracelets.

SUMMARY OF THE INVENTION

An object of the present invention is to provide a particular conformation and/or configuration of the "Omega" chain described hereinabove capable of conferring characteristics of greater utility of the chain for the user.

This object is achieved by providing an "Omega" chain of the type with small rings, in which each one of the rings is constituted by two arcuate portions, with an angular opening less than 180°, identified in the following description with the generic term semi-small rings, the small rings being obtained by using two materials of different quality or composition, so that they may show surfaces of difference in color, brilliance and tonality.

A further object of the invention is to provide a process for the achievement of the chain of the invention, of the type which utilizes small rings made from a tube or a cylinder, which process utilizes such particular working phases that the process is novel with respect to the known processes and also suitable for the production of "Omega" chains which have qualities of compactness, flexibility and aesthetics substantially superior with respect to the similar known products.

In actual operation, the small rings are obtained starting with two laminae of material having different composition, which laminae are placed side by side one with respect to the other, according to their longitudinal direction and being made integral one with respect to the other, by means of a process of welding so as to constitute a bilamina which then is shaped so as to form a tubular or cylindrical product.

The tube is divided with radial cuts so as to form a plurality of small rings, which, being made with two different materials, may be defined "bicolors".

The small rings are then inserted onto a center piece or core of fabric of precious material and the manufactured flexible product so obtained is subjected to a final pressing action to confer to the product some degree of rigidity and compactness while remaining flexible in order to allow the jewel to be shaped and to maintain the shape.

After the pressing operation one obtains a product suitable to make the necklaces called "double face", that is the necklaces which have two surfaces with symmetrically counterposed faces and which have aesthetic characteristics different one from the other.

In addition, operations such as glazing, beating, incision, diamond edging, or similar operations may be carried out on one or both surfaces of the chain in order to improve more substantially the aesthetic appearance of the final product.

BRIEF DESCRIPTION OF THE DRAWINGS

The invention will be more clear by reference to the accompanying drawings which are provided as non-limiting example, of which:

FIGS. 4A–4D show the phases of production of an "Omega" chain of the prior art;

FIG. 5 shows a transversal section of an "Omega" chain of the known type in the present state of the art taken along line V—V of FIG. 4D;

FIGS. 6–17 show the phases of the process used for achieving the chain of the invention as shown in FIG. 1.

DESCRIPTION OF THE INVENTION

Figures 1, 2, 3:
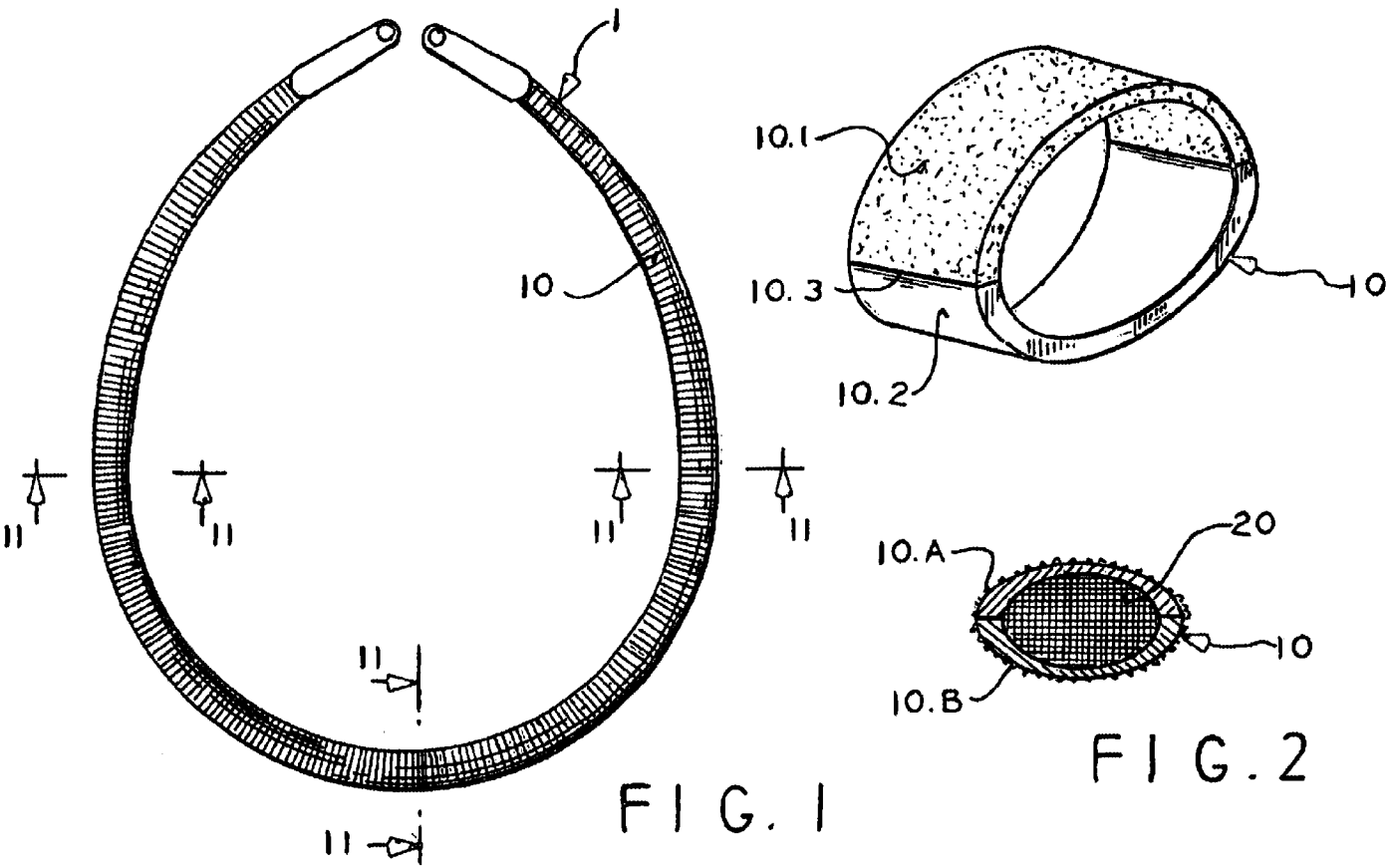
FIG. 1 is an elevational view of a necklace made with an "Omega" chain of the present invention.
FIG. 2 shows a transversal cross-section taken along line II—II of FIG. 1.
FIG. 3 is a perspective view of the "bicolor" small ring used in the "double face" chains of this invention.

As shown in FIGS. 1 to 3, the "Omega" chain of this invention constituted by a plurality of small rings (10), each one is constituted by two semi-small rings (10.1) and (10.2) with arcuate profiles, having an angular opening less than 180°, disposed symmetrically with respect to each other and integral along the two lateral borders (10.3).

All the small rings (10) are inserted and pressed on the internal center piece or core (20) which is a fabric of precious material.

The small rings (10) in addition are characterized by the fact that the two semi-small rings (10.1) and (10.2) are made of different material and/or offer their external surfaces (10.A) and (10.B) worked in a manner that they exhibit aesthetic properties which are different one from the other.

Consequently also the chain (1) when the small rings are inserted on the center piece of fabric (20) offer two faces aesthetically satisfactory but different one from the other and in this manner achieving the chains called "double face".

By way of example, the possibility of achieving chains "Omega double face" is mentioned, with the combination white gold/yellow gold, simply utilizing rings (10) constituted by two integral small rings (10.1) and (10.2), one of them made from laminae of yellow gold and the other made from laminae of white gold (see FIG. 3).

For the purpose of clarifying to a greater extent the difference between the chain "Omega double face" of this invention and the prior art "Omega" chain, there are described, in succession, the two different processes, that is the prior art process (FIGS. 4 and 5) and the novel process which produces the chain of the invention, of FIG. 1 (FIGS. 6–15).

As shown in FIGS. 4A–4D, the prior art "Omega" is made starting from two lamina (3.A) and (3.B), which are shaped one arcuate and the other flat as seen in FIG. 4A, which are made integral to form the tubular element (3.C) as seen in FIG. 4B, which is then divided to form the small rings (30). These rings are inserted on the center piece or core of fabric (20) as seen in FIG. 4C.

With a successive operation of compression, not shown, the final chain (3) of FIG. 4D is obtained. This chain takes a shaped section as seen in FIG. 5 in a manner that only the upper surface (30.A) is visible and aesthetically worked.

Figure 6:
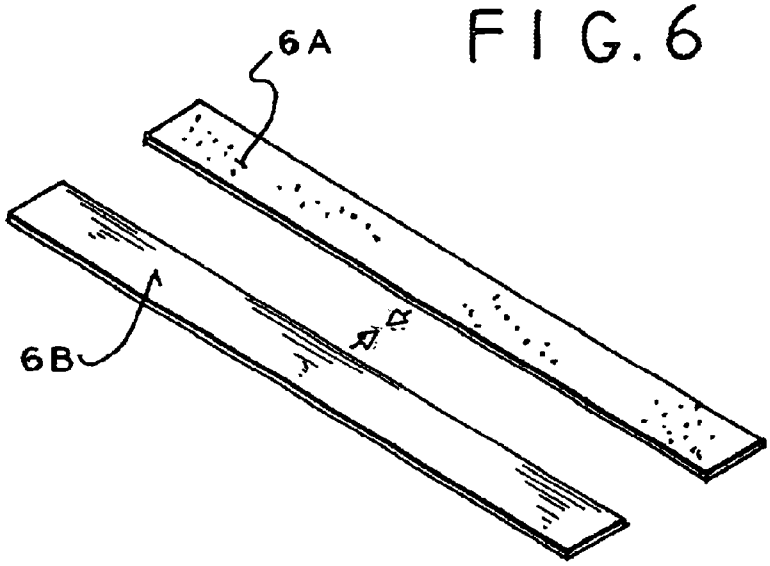
Figure 7:
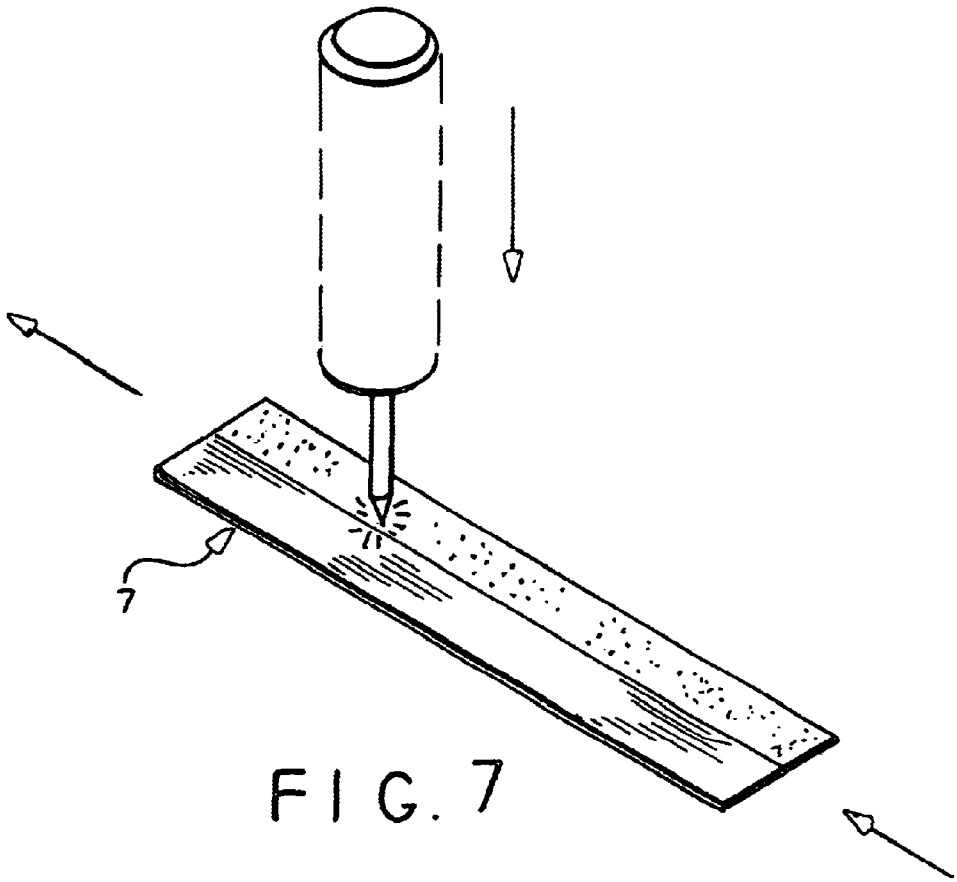

As shown in FIG. 6 and following the chain "Omega double face" of the invention is made starting from two flat laminae (6A) and (6B) shown in FIG. 6, which are disposed close to each other and which are made integral between themselves (FIG. 7) due to an operation of fixed connection preferably welding with or without supply of material, with the laser or with other methods presently known to form a new lamina (7), essentially a bilamina constituted by two components different one from the other.

Consequently, lamina (7) is subjected to a rolling action which transforms the bilamina into a tubular or cylindrical element (8) (FIG. 8) and afterwards the two approached borders of the tubular element are made integral due to an operation of fixed connection, preferably welding, with or without a supply of material with a laser or other well known methods.

As shown in FIG. 8A the welding of the two borders causes the formation in the interior of tubular element of a protruding cordon (9) which is eliminated with the insertion in the tubular element of central piece (110) made of calibrated steel (FIG. 9) which is necessary to carry out the subsequent operation of drawing/calibration.

As seen in FIG. 10, in the passage through the drawing machine (11), the tubular element (8) with the center piece (110) in the interior is transformed into a new tubular element (12). This new tubular element moves to become in close contact with the internal core (20) so that it becomes calibrated in its internal diameter while eliminating in this manner the protruding cordon (9) (compare the detailed FIGS. 10A and 10B).

As shown in FIG. 10C., the invention provides that, on the calibrated tubular element (12) corresponding to the area of reciprocal approachment of the two approached borders a longitudinal line/groove (13) is formed which is useful in the subsequent operation of drawing/shaping of the same tubular element.

As shown in FIG. 11, the line (13), preferably in the shape of a V, is obtained by adding to the drawing machine (11) an engraving tooth (14).

Subsequently the process of the present invention provides for the extraction of the central piece (110) from the calibrated tubular element (12), for instance, by resting the tubular element against plate (15) which has a hole (see FIG. 12).

Still subsequently, as shown in FIG. 13, the process involves the drawing/shaping which transforms the tubular element (12) which has a circular profile into the element (16) with an oval profile. Specifically, the oval profile of the new tubular element (16) must be disposed with the two arcuate profiles in a manner reciprocally symmetrical as shown in FIG. 13B, which is obtained only by inserting in a manner perfectly oriented the tubular element (12) in the drawing machine (17). This is ensured, as shown in FIG. 14, by aligning line (13), present in the tubular element (12) at the entry, to the reference cut (18) present in the body of the drawing machine (17).

Finally as shown by comparing FIG. 13.C and FIG. 13D, the line 13 with the operations of drawing and shaping, is eliminated so that the two borders approach each other perfectly with substantial aesthetic results.

Subsequently, as shown in FIG. 15, the tubular element (16) is subjected to the action of a radial cut to obtain the small rings (19) which subsequently are inserted on the central or core piece (20) (see FIG. 16).

Figures 17, 17A, 17B:
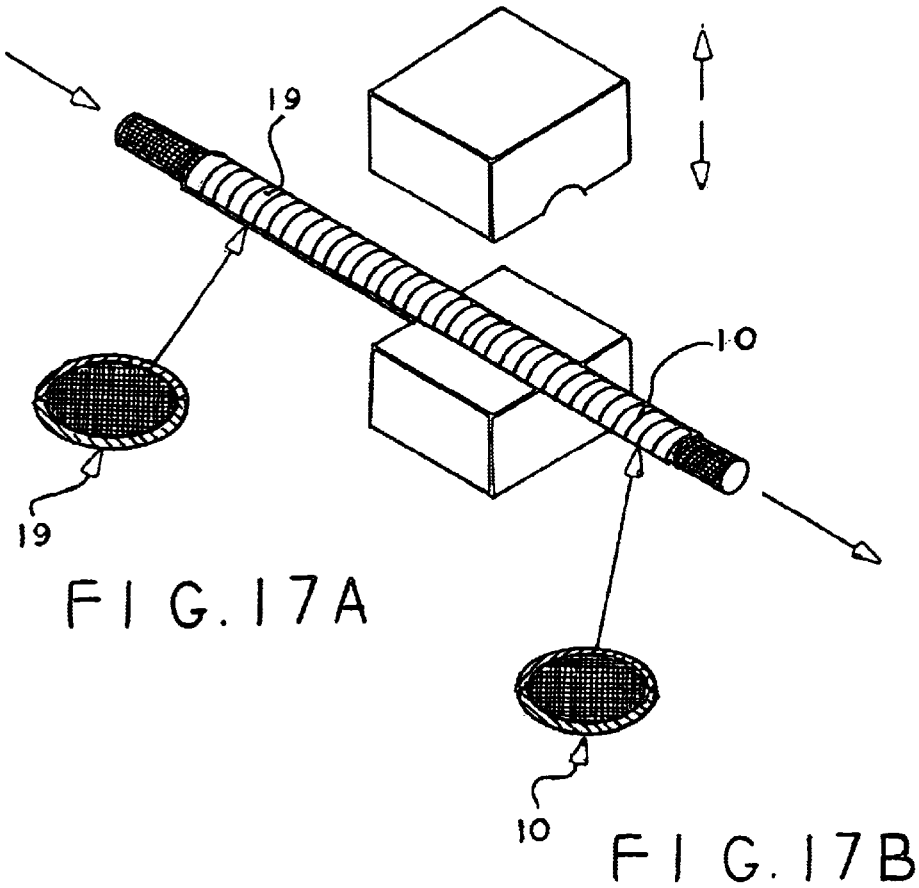

The semiworked product thus obtained is subjected to a final pressing action as shown in FIG. 17, which transforms each ring (19) with an oval profile as shown in FIG. 17A to the rings (10) with a convex and symmetrical profile (see FIG. 17B) and this also causes the profile of the chain "double face" of the invention described hereinabove and shown in FIG. 1.

Obviously a great number of combinations may be carried out by utilizing different dispositions and a number of two or more of approached laminae. In particular, rings of different color on the same face may also be used and on the same face glazed areas alternate with smooth areas may be used.

On the basis of the description and figures shown hereinabove the advantage to the user resulting from the utilization of the chain of this invention is evident because the user may utilize two ornamental elements which may have aesthetic conformations totally different while facing the expense of acquiring a single object.

What is claimed is:

1. An ornamental omega chain having a length and having first and second opposing faces, said chain being used for the production of necklaces, bracelets and other jewelry products capable of being worn to expose either one of said first and second faces of said chain, said chain comprising:

a core (20) formed of a precious material fabric and having a length corresponding to the length of said chain;

a plurality of small rings (10) inserted onto said core in end to end relationship;

each of said small rings (10) comprising a first arcuately convex shaped semi-ring (10.1) and a second arcuately convex shaped semi-ring (10.2), said first and second semi-rings being connected at their ends so as to be counterposed to each other, said plurality of small rings (10) being pressed onto said core (20) so that the first arcuately shaped semi-rings of said plurality of small rings are aligned to form the first face of said chain and the second arcuately shaped semi-rings of said plurality of small rings are aligned to form the second face of said chain.

2. The ornamental omega chain as defined in claim 1, wherein the first arcuately shaped semi-rings (10.1) of said plurality of small rings (10) are made of white gold and the second arcuately shaped semi-rings (10.2) of said plurality of small rings (10) are made of yellow gold.

3. The ornamental omega chain as defined in claim 1, wherein along the length of said chain said first arcuately shaped semi-rings have different colors and said second arcuately shaped semi-rings have different colors.

4. The ornamental omega chain as defined in claim 1, wherein on at least one of said first and second faces thereof glazed and smooth alternating areas are provided.

* * * * *

UNITED STATES PATENT AND TRADEMARK OFFICE

CERTIFICATE OF CORRECTION

PATENT NO. : 6,708,525 B2
DATED : March 23, 2004
INVENTOR(S) : Pietro Rancan

It is certified that error appears in the above-identified patent and that said Letters Patent is hereby corrected as shown below:

Column 1,
Line 5, please add -- , hereby incorporated by reference -- after "abandoned" but before the period.
Line 16, please replace "material" with -- materials --.
Line 23, please replace "plurality-of" with -- plurality of --.
Line 26, please replace the comma after "subjected" with -- . --.
Line 26, please replace "an operation which" with -- This operation --.
Line 29, please add -- , -- after "Specifically".
Line 29, please add -- , -- after "satisfactory".
Line 67, please replace "composition" with -- compositions --.

Column 2,
Line 8, please insert -- as -- after "defined".

Column 3,
Line 39, please add -- , -- after "As shown in FIG. 8A".
Line 53, pelase delete the period after "FIG. 10C".

Column 4,
Line 14, please add -- , -- after "Finally".

Signed and Sealed this

Twenty-second Day of March, 2005

JON W. DUDAS
*Director of the United States Patent and Trademark Office*